US006629752B1

(12) United States Patent
Mayo et al.

(10) Patent No.: US 6,629,752 B1
(45) Date of Patent: Oct. 7, 2003

(54) METHOD OF INK JET PRINTING WITH ENHANCED SHINGLING AND PRINTER APPARATUSES FOR THE SAME

(75) Inventors: Randall David Mayo, Georgetown, KY (US); Jerry Wesley Raider, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/088,552

(22) PCT Filed: Sep. 16, 1999

(86) PCT No.: PCT/US99/21486

§ 371 (c)(1),
(2), (4) Date: Mar. 14, 2002

(87) PCT Pub. No.: WO01/19616

PCT Pub. Date: Mar. 22, 2001

(51) Int. Cl.[7] ..... B41J 2/145; B41J 2/15; B41J 29/38

(52) U.S. Cl. ..... 347/41; 347/40; 347/12; 347/9

(58) Field of Search ..... 347/41, 40, 9, 347/12, 16

(56) References Cited

U.S. PATENT DOCUMENTS 4,401,991 A 8/1983 Martin
5,455,610 A * 10/1995 Harrington ..... 347/43
5,959,646 A 9/1999 Bates et al.
6,022,096 A 2/2000 Hirasawa et al.
6,565,190 B1 * 5/2003 Nobel et al. ..... 347/40

FOREIGN PATENT DOCUMENTS

| | | |
|---|---|---|
| EP | 772150 | 5/1997 |
| JP | 07319644 | 12/1995 |
| JP | 10278246 | 10/1998 |

* cited by examiner

*Primary Examiner*—Thinh Nguyen
(74) *Attorney, Agent, or Firm*—Dinsmore & Shohl, LLP

(57) ABSTRACT

A printing method for ink jet printing on a recording substrate in which a column of N dot forming nozzles for projecting ink onto a printing area are arranged, wherein N is an integer greater than 2. The column of dot forming nozzles are moved horizontally across the printing area and in each column of the printing area the printhead deposits one or more dots from a subgroup of S dot forming nozzles, wherein S is an integer of from 1 to about N−1. In each column of the printing area, not more than every Gth nozzle deposits a dot and a single nozzle deposits a dot not more than every Gth column, wherein G is an integer from 1 to about S. The subgroup of S dot forming nozzles is shifted vertically among the N dot forming nozzles in at least two adjacent columns according to a predetermined pattern. The recording substrate is vertically advanced in a first direction by a height of about Q nozzles, wherein Q=(S/G). Printer apparatuses including the printing method.

41 Claims, 9 Drawing Sheets

| # OF SCANS | SHINGLING METHOD | 8 BIT PATTERN |
|---|---|---|
| 1 PASS | SHINGLE $100_1$ | 1111 1111 |
| 2 PASS | SHINGLE $50_1$ | 1010 1010 |
| | SHINGLE $50_2$ | 0101 0101 |
| 4 PASS | SHINGLE $25_1$ | 1000 1000 |
| | SHINGLE $25_2$ | 0100 0100 |
| | SHINGLE $25_3$ | 0010 0010 |
| | SHINGLE $25_4$ | 0001 0001 |

FIG. 3

| | | | | | | | | | | | | | | | | | | | | | | | |
|---|---|---|---|---|---|---|---|---|---|---|---|---|---|---|---|---|---|---|---|---|---|---|---|
| 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| 1 | 2 | 1 | 2 | 3 | 2 | 1 | 2 | 1 | 2 | 1 | 2 | 1 | 2 | 3 | 2 | 1 | 2 | 1 | 2 | 1 | 2 | 1 | 2 |
| 2 | 1 | 2 | 3 | 2 | 3 | 2 | 1 | 2 | 1 | 2 | 1 | 2 | 3 | 2 | 3 | 2 | 1 | 2 | 1 | 2 | 1 | 2 | 3 |
| 1 | 2 | 3 | 2 | 3 | 2 | 3 | 2 | 1 | 2 | 1 | 2 | 3 | 2 | 3 | 2 | 3 | 2 | 1 | 2 | 1 | 2 | 3 | 2 |
| 2 | 3 | 2 | 3 | 2 | 3 | 2 | 3 | 2 | 1 | 2 | 3 | 2 | 3 | 2 | 3 | 2 | 3 | 2 | 3 | 2 | 3 | 2 | 3 |
| 3 | 2 | 3 | 2 | 3 | 2 | 3 | 2 | 3 | 2 | 3 | 2 | 3 | 2 | 3 | 2 | 3 | 2 | 3 | 2 | 3 | 2 | 3 | 2 |
| 2 | 3 | 2 | 3 | 2 | 3 | 2 | 3 | 2 | 3 | 2 | 3 | 2 | 3 | 2 | 3 | 2 | 3 | 2 | 3 | 2 | 3 | 2 | 3 |
| 3 | 2 | 3 | 2 | 3 | 4 | 3 | 2 | 3 | 2 | 3 | 2 | 3 | 2 | 3 | 4 | 3 | 2 | 3 | 2 | 3 | 2 | 3 | 2 |
| 2 | 3 | 2 | 3 | 4 | 3 | 4 | 3 | 2 | 3 | 2 | 3 | 2 | 3 | 4 | 3 | 4 | 3 | 2 | 3 | 2 | 3 | 2 | 3 |
| 3 | 2 | 3 | 4 | 3 | 4 | 3 | 4 | 3 | 2 | 3 | 2 | 3 | 4 | 3 | 4 | 3 | 4 | 3 | 2 | 3 | 2 | 3 | 4 |
| 2 | 3 | 4 | 3 | 4 | 3 | 4 | 3 | 4 | 3 | 2 | 3 | 4 | 3 | 4 | 3 | 4 | 3 | 4 | 3 | 2 | 3 | 4 | 3 |
| 3 | 4 | 3 | 4 | 3 | 4 | 3 | 4 | 3 | 4 | 3 | 4 | 3 | 4 | 3 | 4 | 3 | 4 | 3 | 4 | 3 | 4 | 3 | 4 |
| 4 | 3 | 4 | 3 | 4 | 3 | 4 | 3 | 4 | 3 | 4 | 3 | 4 | 3 | 4 | 3 | 4 | 3 | 4 | 3 | 4 | 3 | 4 | 3 |
| 3 | 4 | 3 | 4 | 5 | 4 | 3 | 4 | 3 | 4 | 3 | 4 | 3 | 4 | 5 | 4 | 3 | 4 | 3 | 4 | 3 | 4 | 3 | 4 |
| 4 | 3 | 4 | 5 | 4 | 5 | 4 | 3 | 4 | 3 | 4 | 3 | 4 | 5 | 4 | 5 | 4 | 3 | 4 | 3 | 4 | 3 | 4 | 5 |
| 3 | 4 | 5 | 4 | 5 | 4 | 5 | 4 | 3 | 4 | 3 | 4 | 5 | 4 | 5 | 4 | 5 | 4 | 3 | 4 | 3 | 4 | 5 | 4 |
| 4 | 5 | 4 | 5 | 4 | 5 | 4 | 5 | 4 | 3 | 4 | 5 | 4 | 5 | 4 | 5 | 4 | 5 | 4 | 3 | 4 | 5 | 4 | 5 |
| 5 | 4 | 5 | 4 | 5 | 4 | 5 | 4 | 5 | 4 | 5 | 4 | 5 | 4 | 5 | 4 | 5 | 4 | 5 | 4 | 5 | 4 | 5 | 4 |
| 4 | 5 | 4 | 5 | 4 | 5 | 4 | 5 | 4 | 5 | 4 | 5 | 4 | 5 | 4 | 5 | 4 | 5 | 4 | 5 | 4 | 5 | 4 | 5 |
| 5 | 4 | 5 | 4 | 5 | 6 | 5 | 4 | 5 | 4 | 5 | 4 | 5 | 4 | 5 | 6 | 5 | 4 | 5 | 4 | 5 | 4 | 5 | 4 |
| 4 | 5 | 4 | 5 | 6 | 5 | 6 | 5 | 4 | 5 | 4 | 5 | 4 | 5 | 6 | 5 | 6 | 5 | 4 | 5 | 4 | 5 | 4 | 5 |
| 5 | 4 | 5 | 6 | 5 | 6 | 5 | 6 | 5 | 4 | 5 | 4 | 5 | 6 | 5 | 6 | 5 | 6 | 5 | 4 | 5 | 4 | 5 | 6 |
| 4 | 5 | 6 | 5 | 6 | 5 | 6 | 5 | 6 | 5 | 4 | 5 | 6 | 5 | 6 | 5 | 6 | 5 | 6 | 5 | 4 | 5 | 6 | 5 |

FIG. 4

| | | | | | | | | | | | | | | | | | | | | | | | |
|---|---|---|---|---|---|---|---|---|---|---|---|---|---|---|---|---|---|---|---|---|---|---|---|
| 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| 1 | 2 | 1 | 2 | 3 | 2 | 1 | 2 | 1 | 2 | 1 | 2 | 1 | 2 | 3 | 2 | 1 | 2 | 1 | 2 | 1 | 2 | 1 | 2 |
| 2 | 1 | 2 | 3 | 2 | 3 | 2 | 1 | 2 | 1 | 2 | 1 | 2 | 3 | 2 | 3 | 2 | 1 | 2 | 1 | 2 | 1 | 2 | 3 |
| 1 | 2 | 3 | 2 | 3 | 2 | 3 | 2 | 1 | 2 | 1 | 2 | 3 | 2 | 3 | 2 | 3 | 2 | 1 | 2 | 1 | 2 | 3 | 2 |
| 2 | 3 | 2 | 3 | 2 | 3 | 2 | 3 | 2 | 3 | 2 | 3 | 2 | 3 | 2 | 3 | 2 | 3 | 2 | 3 | 2 | 3 | 2 | 3 |
| 3 | 2 | 3 | 2 | 3 | 2 | 3 | 2 | 3 | 2 | 3 | 2 | 3 | 2 | 3 | 2 | 3 | 2 | 3 | 2 | 3 | 2 | 3 | 2 |
| 2 | 3 | 2 | 3 | 2 | 3 | 2 | 3 | 2 | 3 | 2 | 3 | 2 | 3 | 2 | 3 | 2 | 3 | 2 | 3 | 2 | 3 | 2 | 3 |
| 3 | 2 | 3 | 2 | 3 | 4 | 3 | 2 | 3 | 2 | 3 | 2 | 3 | 2 | 3 | 4 | 3 | 2 | 3 | 2 | 3 | 2 | 3 | 2 |
| 2 | 3 | 2 | 3 | 4 | 3 | 4 | 3 | 2 | 3 | 2 | 3 | 2 | 3 | 4 | 3 | 4 | 3 | 2 | 3 | 2 | 3 | 2 | 3 |
| 3 | 2 | 3 | 4 | 3 | 4 | 3 | 4 | 3 | 2 | 3 | 2 | 3 | 4 | 3 | 4 | 3 | 4 | 3 | 2 | 3 | 2 | 3 | 4 |
| 4 | 3 | 4 | 3 | 4 | 3 | 4 | 3 | 4 | 3 | 4 | 3 | 4 | 3 | 4 | 3 | 4 | 3 | 4 | 3 | 4 | 3 | 4 | 3 |
| 3 | 4 | 3 | 4 | 3 | 4 | 3 | 4 | 3 | 4 | 3 | 4 | 3 | 4 | 3 | 4 | 3 | 4 | 3 | 4 | 3 | 4 | 3 | 4 |
| 4 | 3 | 4 | 3 | 4 | 3 | 4 | 3 | 4 | 3 | 4 | 3 | 4 | 3 | 4 | 3 | 4 | 3 | 4 | 3 | 4 | 3 | 4 | 3 |
| 3 | 4 | 3 | 4 | 5 | 4 | 3 | 4 | 3 | 4 | 3 | 4 | 3 | 4 | 5 | 4 | 3 | 4 | 3 | 4 | 3 | 4 | 3 | 4 |
| 4 | 3 | 4 | 5 | 4 | 5 | 4 | 3 | 4 | 3 | 4 | 3 | 4 | 5 | 4 | 5 | 4 | 3 | 4 | 3 | 4 | 3 | 4 | 5 |
| 3 | 4 | 5 | 4 | 5 | 4 | 5 | 4 | 3 | 4 | 3 | 4 | 5 | 4 | 5 | 4 | 5 | 4 | 3 | 4 | 3 | 4 | 5 | 4 |
| 4 | 5 | 4 | 5 | 4 | 5 | 4 | 5 | 4 | 5 | 4 | 5 | 4 | 5 | 4 | 5 | 4 | 5 | 4 | 5 | 4 | 5 | 4 | 5 |
| 5 | 4 | 5 | 4 | 5 | 4 | 5 | 4 | 5 | 4 | 5 | 4 | 5 | 4 | 5 | 4 | 5 | 4 | 5 | 4 | 5 | 4 | 5 | 4 |
| 4 | 5 | 4 | 5 | 4 | 5 | 4 | 5 | 4 | 5 | 4 | 5 | 4 | 5 | 4 | 5 | 4 | 5 | 4 | 5 | 4 | 5 | 4 | 5 |
| 5 | 4 | 5 | 4 | 5 | 6 | 5 | 4 | 5 | 4 | 5 | 4 | 5 | 4 | 5 | 6 | 5 | 4 | 5 | 4 | 5 | 4 | 5 | 4 |
| 4 | 5 | 4 | 5 | 6 | 5 | 6 | 5 | 4 | 5 | 4 | 5 | 4 | 5 | 6 | 5 | 6 | 5 | 4 | 5 | 4 | 5 | 4 | 5 |
| 5 | 4 | 5 | 6 | 5 | 6 | 5 | 6 | 5 | 4 | 5 | 4 | 5 | 6 | 5 | 6 | 5 | 6 | 5 | 4 | 5 | 4 | 5 | 6 |
| 4 | 5 | 6 | 5 | 6 | 5 | 6 | 5 | 6 | 5 | 4 | 5 | 6 | 5 | 6 | 5 | 6 | 5 | 6 | 5 | 4 | 5 | 6 | 5 |

FIG. 5

| | | | | | | | | | | | | | | | | | | | | | | | |
|---|---|---|---|---|---|---|---|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 2 | 2 | 1 | 1 | 1 | 1 | 1 | 1 | 1 | 1 | 2 | 2 | 2 | 1 | 1 | 1 | 1 | 1 | 1 | 1 |
| 1 | 1 | 1 | 2 | 2 | 2 | 2 | 1 | 1 | 1 | 1 | 1 | 1 | 2 | 2 | 2 | 2 | 2 | 1 | 1 | 1 | 1 | 1 | 1 |
| 1 | 1 | 2 | 2 | 2 | 2 | 2 | 2 | 1 | 1 | 1 | 1 | 2 | 2 | 2 | 2 | 2 | 2 | 2 | 1 | 1 | 1 | 1 | 2 |
| 1 | 2 | 2 | 2 | 2 | 2 | 2 | 2 | 2 | 1 | 1 | 2 | 2 | 2 | 2 | 2 | 2 | 2 | 2 | 2 | 1 | 1 | 2 | 2 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 2 | 2 | 2 | 2 | 3 | 3 | 2 | 2 | 2 | 2 | 2 | 2 | 2 | 2 | 3 | 3 | 3 | 2 | 2 | 2 | 2 | 2 | 2 | 2 |
| 2 | 2 | 2 | 3 | 3 | 3 | 3 | 2 | 2 | 2 | 2 | 2 | 2 | 3 | 3 | 3 | 3 | 3 | 2 | 2 | 2 | 2 | 2 | 2 |
| 2 | 2 | 3 | 3 | 3 | 3 | 3 | 3 | 2 | 2 | 2 | 2 | 3 | 3 | 3 | 3 | 3 | 3 | 3 | 2 | 2 | 2 | 2 | 3 |
| 2 | 3 | 3 | 3 | 3 | 3 | 3 | 3 | 3 | 2 | 2 | 3 | 3 | 3 | 3 | 3 | 3 | 3 | 3 | 3 | 2 | 2 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 3 | 3 | 3 | 3 | 4 | 4 | 3 | 3 | 3 | 3 | 3 | 3 | 3 | 3 | 4 | 4 | 4 | 3 | 3 | 3 | 3 | 3 | 3 | 3 |
| 3 | 3 | 3 | 4 | 4 | 4 | 4 | 3 | 3 | 3 | 3 | 3 | 3 | 4 | 4 | 4 | 4 | 4 | 3 | 3 | 3 | 3 | 3 | 3 |
| 3 | 3 | 4 | 4 | 4 | 4 | 4 | 4 | 3 | 3 | 3 | 3 | 4 | 4 | 4 | 4 | 4 | 4 | 4 | 3 | 3 | 3 | 3 | 4 |
| 3 | 4 | 4 | 4 | 4 | 4 | 4 | 4 | 4 | 3 | 3 | 4 | 4 | 4 | 4 | 4 | 4 | 4 | 4 | 4 | 3 | 3 | 4 | 4 |
| 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 |
| 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 |

FIG. 6

| | | | | | | | | | | | | | | | | | | | | | | | |
|---|---|---|---|---|---|---|---|---|---|---|---|---|---|---|---|---|---|---|---|---|---|---|---|
| 1 | 2 | 3 | 4 | 1 | 2 | 3 | 4 | 1 | 2 | 3 | 4 | 1 | 2 | 3 | 4 | 1 | 2 | 3 | 4 | 1 | 2 | 3 | 4 |
| 4 | 1 | 2 | 3 | 4 | 1 | 2 | 3 | 4 | 1 | 2 | 3 | 4 | 1 | 2 | 3 | 4 | 1 | 2 | 3 | 4 | 1 | 2 | 3 |
| 3 | 4 | 5 | 2 | 3 | 4 | 1 | 2 | 3 | 4 | 5 | 2 | 3 | 4 | 1 | 2 | 3 | 4 | 5 | 2 | 3 | 4 | 1 | 2 |
| 2 | 3 | 4 | 5 | 2 | 3 | 4 | 5 | 2 | 3 | 4 | 5 | 2 | 3 | 4 | 5 | 2 | 3 | 4 | 5 | 2 | 3 | 4 | 5 |
| 5 | 2 | 3 | 4 | 5 | 2 | 3 | 4 | 5 | 2 | 3 | 4 | 5 | 2 | 3 | 4 | 5 | 2 | 3 | 4 | 5 | 2 | 3 | 4 |
| 4 | 5 | 6 | 3 | 4 | 5 | 2 | 3 | 4 | 5 | 6 | 3 | 4 | 5 | 2 | 3 | 4 | 5 | 6 | 3 | 4 | 5 | 2 | 3 |
| 3 | 4 | 5 | 6 | 3 | 4 | 5 | 6 | 3 | 4 | 5 | 6 | 3 | 4 | 5 | 6 | 3 | 4 | 5 | 6 | 3 | 4 | 5 | 6 |
| 6 | 3 | 4 | 5 | 6 | 3 | 4 | 5 | 6 | 3 | 4 | 5 | 6 | 3 | 4 | 5 | 6 | 3 | 4 | 5 | 6 | 3 | 4 | 5 |
| 5 | 6 | 7 | 4 | 5 | 6 | 3 | 4 | 5 | 6 | 7 | 4 | 5 | 6 | 3 | 4 | 5 | 6 | 7 | 4 | 5 | 6 | 3 | 4 |
| 4 | 5 | 6 | 7 | 4 | 5 | 6 | 7 | 4 | 5 | 6 | 7 | 4 | 5 | 6 | 7 | 4 | 5 | 6 | 7 | 4 | 5 | 6 | 7 |
| 7 | 4 | 5 | 6 | 7 | 4 | 5 | 6 | 7 | 4 | 5 | 6 | 7 | 4 | 5 | 6 | 7 | 4 | 5 | 6 | 7 | 4 | 5 | 6 |
| 6 | 7 | 8 | 5 | 6 | 7 | 4 | 5 | 6 | 7 | 8 | 5 | 6 | 7 | 4 | 5 | 6 | 7 | 8 | 5 | 6 | 7 | 4 | 5 |
| 5 | 6 | 7 | 8 | 5 | 6 | 7 | 8 | 5 | 6 | 7 | 8 | 5 | 6 | 7 | 8 | 5 | 6 | 7 | 8 | 5 | 6 | 7 | 8 |
| 8 | 5 | 6 | 7 | 8 | 5 | 6 | 7 | 8 | 5 | 6 | 7 | 8 | 5 | 6 | 7 | 8 | 5 | 6 | 7 | 8 | 5 | 6 | 7 |
| 7 | 8 | 9 | 6 | 7 | 8 | 5 | 6 | 7 | 8 | 9 | 6 | 7 | 8 | 5 | 6 | 7 | 8 | 9 | 6 | 7 | 8 | 5 | 6 |
| 6 | 7 | 8 | 9 | 6 | 7 | 8 | 9 | 6 | 7 | 8 | 9 | 6 | 7 | 8 | 9 | 6 | 7 | 8 | 9 | 6 | 7 | 8 | 9 |
| 9 | 6 | 7 | 8 | 9 | 6 | 7 | 8 | 9 | 6 | 7 | 8 | 9 | 6 | 7 | 8 | 9 | 6 | 7 | 8 | 9 | 6 | 7 | 8 |
| 8 | 9 | 10 | 7 | 8 | 9 | 6 | 7 | 8 | 9 | 10 | 7 | 8 | 9 | 6 | 7 | 8 | 9 | 10 | 7 | 8 | 9 | 6 | 7 |
| 7 | 8 | 9 | 10 | 7 | 8 | 9 | 10 | 7 | 8 | 9 | 10 | 7 | 8 | 9 | 10 | 7 | 8 | 9 | 10 | 7 | 8 | 9 | 10 |
| 10 | 7 | 8 | 9 | 10 | 7 | 8 | 9 | 10 | 7 | 8 | 9 | 10 | 7 | 8 | 9 | 10 | 7 | 8 | 9 | 10 | 7 | 8 | 9 |
| 9 | 10 | 11 | 8 | 9 | 10 | 7 | 8 | 9 | 10 | 11 | 8 | 9 | 10 | 7 | 8 | 9 | 10 | 11 | 8 | 9 | 10 | 7 | 8 |
| 8 | 9 | 10 | 11 | 8 | 9 | 10 | 11 | 8 | 9 | 10 | 11 | 8 | 9 | 10 | 11 | 8 | 9 | 10 | 11 | 8 | 9 | 10 | 11 |
| 11 | 8 | 9 | 10 | 11 | 8 | 9 | 10 | 11 | 8 | 9 | 10 | 11 | 8 | 9 | 10 | 11 | 8 | 9 | 10 | 11 | 8 | 9 | 10 |

FIG. 7

| | | | | | | | | | | | | | | | | | | | | | | | |
|---|---|---|---|---|---|---|---|---|---|---|---|---|---|---|---|---|---|---|---|---|---|---|---|
| 1 | 2 | 3 | 4 | 1 | 2 | 3 | 4 | 1 | 2 | 3 | 4 | 1 | 2 | 3 | 4 | 1 | 2 | 3 | 4 | 1 | 2 | 3 | 4 |
| 4 | 1 | 2 | 3 | 4 | 5 | 2 | 3 | 4 | 1 | 2 | 3 | 4 | 5 | 2 | 3 | 4 | 1 | 2 | 3 | 4 | 5 | 2 | 3 |
| 3 | 4 | 5 | 2 | 3 | 4 | 1 | 2 | 3 | 4 | 5 | 2 | 3 | 4 | 1 | 2 | 3 | 4 | 5 | 2 | 3 | 4 | 1 | 2 |
| 2 | 3 | 4 | 5 | 2 | 3 | 4 | 5 | 2 | 3 | 4 | 5 | 2 | 3 | 4 | 5 | 2 | 3 | 4 | 5 | 2 | 3 | 4 | 5 |
| 5 | 2 | 3 | 4 | 5 | 6 | 3 | 4 | 5 | 2 | 3 | 4 | 5 | 6 | 3 | 4 | 5 | 2 | 3 | 4 | 5 | 6 | 3 | 4 |
| 4 | 5 | 6 | 3 | 4 | 5 | 2 | 3 | 4 | 5 | 6 | 3 | 4 | 5 | 2 | 3 | 4 | 5 | 6 | 3 | 4 | 5 | 2 | 3 |
| 3 | 4 | 5 | 6 | 3 | 4 | 5 | 6 | 3 | 4 | 5 | 6 | 3 | 4 | 5 | 6 | 3 | 4 | 5 | 6 | 3 | 4 | 5 | 6 |
| 6 | 3 | 4 | 5 | 6 | 7 | 4 | 5 | 6 | 3 | 4 | 5 | 6 | 7 | 4 | 5 | 6 | 3 | 4 | 5 | 6 | 7 | 4 | 5 |
| 5 | 6 | 7 | 4 | 5 | 6 | 3 | 4 | 5 | 6 | 7 | 4 | 5 | 6 | 3 | 4 | 5 | 6 | 7 | 4 | 5 | 6 | 3 | 4 |
| 4 | 5 | 6 | 7 | 4 | 5 | 6 | 7 | 4 | 5 | 6 | 7 | 4 | 5 | 6 | 7 | 4 | 5 | 6 | 7 | 4 | 5 | 6 | 7 |
| 7 | 4 | 5 | 6 | 7 | 8 | 5 | 6 | 7 | 4 | 5 | 6 | 7 | 8 | 5 | 6 | 7 | 4 | 5 | 6 | 7 | 8 | 5 | 6 |
| 6 | 7 | 8 | 5 | 6 | 7 | 4 | 5 | 6 | 7 | 8 | 5 | 6 | 7 | 4 | 5 | 6 | 7 | 8 | 5 | 6 | 7 | 4 | 5 |
| 5 | 6 | 7 | 8 | 5 | 6 | 7 | 8 | 5 | 6 | 7 | 8 | 5 | 6 | 7 | 8 | 5 | 6 | 7 | 8 | 5 | 6 | 7 | 8 |
| 8 | 5 | 6 | 7 | 8 | 9 | 6 | 7 | 8 | 5 | 6 | 7 | 8 | 9 | 6 | 7 | 8 | 5 | 6 | 7 | 8 | 9 | 6 | 7 |
| 7 | 8 | 9 | 6 | 7 | 8 | 5 | 6 | 7 | 8 | 9 | 6 | 7 | 8 | 5 | 6 | 7 | 8 | 9 | 6 | 7 | 8 | 5 | 6 |
| 6 | 7 | 8 | 9 | 6 | 7 | 8 | 9 | 6 | 7 | 8 | 9 | 6 | 7 | 8 | 9 | 6 | 7 | 8 | 9 | 6 | 7 | 8 | 9 |
| 9 | 6 | 7 | 8 | 9 | 10 | 7 | 8 | 9 | 6 | 7 | 8 | 9 | 10 | 7 | 8 | 9 | 6 | 7 | 8 | 9 | 10 | 7 | 8 |
| 8 | 9 | 10 | 7 | 8 | 9 | 6 | 7 | 8 | 9 | 10 | 7 | 8 | 9 | 6 | 7 | 8 | 9 | 10 | 7 | 8 | 9 | 6 | 7 |
| 7 | 8 | 9 | 10 | 7 | 8 | 9 | 10 | 7 | 8 | 9 | 10 | 7 | 8 | 9 | 10 | 7 | 8 | 9 | 10 | 7 | 8 | 9 | 10 |
| 10 | 7 | 8 | 9 | 10 | 11 | 8 | 9 | 10 | 7 | 8 | 9 | 10 | 11 | 8 | 9 | 10 | 7 | 8 | 9 | 10 | 11 | 8 | 9 |
| 9 | 10 | 11 | 8 | 9 | 10 | 7 | 8 | 9 | 10 | 11 | 8 | 9 | 10 | 7 | 8 | 9 | 10 | 11 | 8 | 9 | 10 | 7 | 8 |
| 8 | 9 | 10 | 11 | 8 | 9 | 10 | 11 | 8 | 9 | 10 | 11 | 8 | 9 | 10 | 11 | 8 | 9 | 10 | 11 | 8 | 9 | 10 | 11 |
| 11 | 8 | 9 | 10 | 11 | 8 | 9 | 10 | 11 | 8 | 9 | 10 | 11 | 8 | 9 | 10 | 11 | 8 | 9 | 10 | 11 | 8 | 9 | 10 |

FIG. 8

| | | | | | | | | | | | | | | | | | | | | | | | |
|---|---|---|---|---|---|---|---|---|---|---|---|---|---|---|---|---|---|---|---|---|---|---|---|
| 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| 1 | 2 | 1 | 2 | 3 | 2 | 1 | 2 | 1 | 2 | 1 | 2 | 3 | 2 | 1 | 2 | 1 | 2 | 1 | 2 | 3 | 2 | 1 | 2 |
| 2 | 1 | 2 | 1 | 2 | 3 | 2 | 1 | 2 | 1 | 2 | 1 | 2 | 3 | 2 | 1 | 2 | 1 | 2 | 1 | 2 | 3 | 2 | 1 |
| 1 | 2 | 3 | 2 | 3 | 2 | 3 | 2 | 1 | 2 | 3 | 2 | 3 | 2 | 3 | 2 | 1 | 2 | 3 | 2 | 3 | 2 | 3 | 2 |
| 2 | 1 | 2 | 3 | 2 | 3 | 2 | 3 | 2 | 1 | 2 | 3 | 2 | 3 | 2 | 3 | 2 | 1 | 2 | 3 | 2 | 3 | 2 | 3 |
| 3 | 2 | 3 | 2 | 3 | 2 | 3 | 2 | 3 | 2 | 3 | 2 | 3 | 2 | 3 | 2 | 3 | 2 | 3 | 2 | 3 | 2 | 3 | 2 |
| 2 | 3 | 2 | 3 | 2 | 3 | 2 | 3 | 2 | 3 | 2 | 3 | 2 | 3 | 2 | 3 | 2 | 3 | 2 | 3 | 2 | 3 | 2 | 3 |
| 3 | 2 | 3 | 2 | 3 | 4 | 3 | 2 | 3 | 2 | 3 | 2 | 3 | 4 | 3 | 2 | 3 | 2 | 3 | 2 | 3 | 4 | 3 | 2 |
| 2 | 3 | 2 | 3 | 4 | 3 | 2 | 3 | 2 | 3 | 2 | 3 | 4 | 3 | 2 | 3 | 2 | 3 | 2 | 3 | 4 | 3 | 2 | 3 |
| 3 | 2 | 3 | 4 | 3 | 4 | 3 | 4 | 3 | 2 | 3 | 4 | 3 | 4 | 3 | 4 | 3 | 2 | 3 | 4 | 3 | 4 | 3 | 4 |
| 2 | 3 | 4 | 3 | 4 | 3 | 4 | 3 | 2 | 3 | 4 | 3 | 4 | 3 | 4 | 3 | 2 | 3 | 4 | 3 | 4 | 3 | 4 | 3 |
| 3 | 4 | 3 | 4 | 3 | 4 | 3 | 4 | 3 | 4 | 3 | 4 | 3 | 4 | 3 | 4 | 3 | 4 | 3 | 4 | 3 | 4 | 3 | 4 |
| 4 | 3 | 4 | 3 | 4 | 3 | 4 | 3 | 4 | 3 | 4 | 3 | 4 | 3 | 4 | 3 | 4 | 3 | 4 | 3 | 4 | 3 | 4 | 3 |
| 3 | 4 | 3 | 4 | 5 | 4 | 3 | 4 | 3 | 4 | 3 | 4 | 5 | 4 | 3 | 4 | 3 | 4 | 3 | 4 | 5 | 4 | 3 | 4 |
| 4 | 3 | 4 | 3 | 4 | 5 | 4 | 3 | 4 | 3 | 4 | 3 | 4 | 5 | 4 | 3 | 4 | 3 | 4 | 3 | 4 | 5 | 4 | 3 |
| 3 | 4 | 5 | 4 | 5 | 4 | 5 | 4 | 3 | 4 | 5 | 4 | 5 | 4 | 5 | 4 | 3 | 4 | 5 | 4 | 5 | 4 | 5 | 4 |
| 4 | 3 | 4 | 5 | 4 | 5 | 4 | 5 | 4 | 3 | 4 | 5 | 4 | 5 | 4 | 5 | 4 | 3 | 4 | 5 | 4 | 5 | 4 | 5 |
| 5 | 4 | 5 | 4 | 5 | 4 | 5 | 4 | 5 | 4 | 5 | 4 | 5 | 4 | 5 | 4 | 5 | 4 | 5 | 4 | 5 | 4 | 5 | 4 |
| 4 | 5 | 4 | 5 | 4 | 5 | 4 | 5 | 4 | 5 | 4 | 5 | 4 | 5 | 4 | 5 | 4 | 5 | 4 | 5 | 4 | 5 | 4 | 5 |
| 5 | 4 | 5 | 4 | 5 | 6 | 5 | 4 | 5 | 4 | 5 | 4 | 5 | 6 | 5 | 4 | 5 | 4 | 5 | 4 | 5 | 6 | 5 | 4 |
| 4 | 5 | 4 | 5 | 6 | 5 | 4 | 5 | 4 | 5 | 4 | 5 | 6 | 5 | 4 | 5 | 4 | 5 | 4 | 5 | 6 | 5 | 4 | 5 |
| 5 | 4 | 5 | 6 | 5 | 6 | 5 | 6 | 5 | 4 | 5 | 6 | 5 | 6 | 5 | 6 | 5 | 4 | 5 | 6 | 5 | 6 | 5 | 6 |
| 4 | 5 | 6 | 5 | 6 | 5 | 6 | 5 | 4 | 5 | 6 | 5 | 6 | 5 | 6 | 5 | 4 | 5 | 6 | 5 | 6 | 5 | 6 | 5 |

FIG. 9

METHOD OF INK JET PRINTING WITH ENHANCED SHINGLING AND PRINTER APPARATUSES FOR THE SAME

FIELD OF THE INVENTION

The present invention relates to ink jet printers and methods, and more particularly, to such methods and apparatus for shingled printing.

BACKGROUND OF THE INVENTION

Ink jet printers commonly include a printhead which is mounted on a carriage assembly. The carriage assembly is moveable in a transverse direction, relative to an advance direction of a print medium such as paper. As the printhead is moved across the print medium during a particular pass of the carriage assembly, ink is selectively jetted from dot forming nozzles formed in the printhead and deposited on the print medium at corresponding ink dot placement locations in the image area of the print medium. Since the printhead moves in a direction transverse (e.g., perpendicular) to the advance direction of the print medium, each dot forming nozzle passes in a linear manner over the print medium. The line associated with each dot forming nozzle which overlies the print medium is commonly referred to as a raster or raster line. A plurality of rasters which extend across the image area of the print medium are disposed vertically adjacent to each other in the advance direction of the print medium.

Ink dot placement-related problems vary in severity with a large number of printer-related variables including desired printing speed, printhead array configurations, transfer versus direct printing, aqueous versus phase changing, required printing resolution, print post processing, if any, and the type of print medium. In particular, color ink jet printing requires careful placement of ink dots to meet current resolution and color fidelity requirements without producing undesired printing artifacts.

The field of ink jet printing is replete with references describing solutions to problems associated with placing ink dots on a print medium. In one known process, a subgroup, which is the same for all print positions of a print line, is formed from a partial number of dot forming nozzles. The dot forming nozzles of the subgroup are selectively controlled at every print position according to predetermined print data. Accordingly, depending on the print data of the respective dot forming nozzle, ink may be applied to the recording substrate. After passing across a print line, the recording substrate is advanced in accordance with the length of the subgroup in the forward feed direction. A printhead can then continue to make recordings during the subsequent return movement (bi-directional printing) or only when a new advancing movement of the printhead is effected (unidirectional printing).

If the forward feed of the recording substrate in serial printers does not correspond exactly to the respective height of the pattern which is printed line by line, adjacent print lines overlap, presenting overlaid inked areas of superimposed lines (dark stripes), or are visibly distant from one another (light stripes). These effects of incorrect line spacing are referred to in the art as line continuation errors.

Such line continuation errors are caused, for example, by manufacturing tolerances of a mechanical feed of the recording substrate. Also, the amount of feed generally varies with the thickness of the recording substrate so that costly adjustments are often needed when recording substrates with different thicknesses are employed.

One known improvement for this problem of line continuation errors is known as shingling or interlaced printing. For a 50% shingling mode (i.e., 2-pass or 50% interlace level), approximately 50% of the dots are placed on any given pass of the printhead. The candidate dots in a particular pass are selected according to a checkerboard pattern. The remaining 50% of the dots necessary to form the desired images are placed on a subsequent pass of the printhead. For a printhead with vertically disposed colors, and a raster which contains cyan, magenta and yellow dots, the printhead must be passed at least six times with a 50% shingling method, twice depositing any cyan dots present in the given raster, twice depositing any magenta dots and twice depositing any yellow dots.

While the shingling method does reduce the line continuation errors of the ink jet printing, some line continuation errors are still noticeable. Furthermore, when a shingling method is employed, the printing speed is greatly reduced. Accordingly, a printing method that further reduces the line continuation errors and maintains print speed is desired.

SUMMARY OF THE INVENTION

Accordingly, it is an object of the present invention to provide novel printing methods which overcome one or more disadvantages of the prior art. It is a more specific object of the invention to provide novel printing methods comprising an enhanced shingling method, which when employed in ink jet printing reduce line continuation errors and maintain acceptable printing speeds. It is a further object to provide apparatus for achieving such methods.

These and additional objects and advantages are provided by printing methods comprising the enhanced shingling of the present invention.

In a first embodiment, the printing methods comprise the steps of arranging a column of N dot forming nozzles for projecting ink onto a printing area comprising columns on a recording substrate, wherein N is an integer greater than 2. A scanning step is performed by moving the column of dot forming nozzles horizontally across the printing area and, in each column of the printing area, depositing one or more dots from a subgroup comprised of S dot forming nozzles from the column of N dot forming nozzles, wherein S is an integer of from 1 to about N−1. During the scanning step in each column of the printing area, not more than every Gth nozzle deposits a dot and a single nozzle deposits a dot not more than every Gth column, wherein G is an integer from 2 to about S. The subgroup of S dot forming nozzles is shifted vertically among the N dot forming nozzles in at least two adjacent columns according to a predetermined pattern. The recording substrate is vertically advanced in a first direction by a height of about Q nozzles, wherein Q=(S/G). The scanning step is then repeated as necessary.

In another embodiment of the present invention, the printing methods comprise the steps of arranging a column of N dot forming nozzles for projecting ink onto a printing area comprising columns on a recording substrate, wherein N is an integer greater than 2. A scanning step is performed by moving the column of dot forming nozzles horizontally across the printing area and, in each column of the printing area, depositing one or more dots from a subgroup comprised of S dot forming nozzles from a column of N dot forming nozzles, wherein S is an integer of from 1 to about N−1. During the scanning step in each column of the printing area, not more than every Gth nozzle deposits a dot and a single nozzle deposits a dot not more than every Gth column, wherein G is an integer from 1 to about S. The subgroup of S dot forming nozzles is shifted vertically among the N dot forming nozzles in at least two adjacent columns according to a predetermined pattern, with a provision that the predetermined pattern is not a periodic function. The recording substrate is advanced vertically in a first direction by a height of about Q nozzles wherein Q=(S/G). The scanning step is then repeated as necessary.

The printer apparatus of the present invention comprises a serial printhead, a horizontal scan drive, a vertical scan drive, and a control means. The serial printhead is comprised of a column of N dot forming nozzles for projecting ink onto a printing area comprising columns on a recording substrate, wherein N is an integer greater than 2. The control means is operative to activate the horizontal scan drive to perform and move the serial printhead horizontally across the printing area, wherein in each column of the printing area, the printhead deposits one or more dots from a subgroup comprised of S dot forming nozzles from the column of N dot forming nozzles, wherein S is an integer of from 1 to about N−1. During the scanning step, the control means is further operative to activate not more than every Gth nozzle to deposit a dot in each column of the printing area, to activate a single nozzle to deposit a dot not more than every Gth column, wherein G is an integer from 2 about S, and to vertically shift the subgroup of S dot forming nozzles among the N dot forming nozzles in at least two adjacent columns according to a predetermined pattern. The control means is further operative to activate the vertical scan drive to vertically advance the recording substrate by a height of about Q nozzles, wherein Q=(S/G), and then repeat the scanning step as necessary. The scanning step is then repeated as necessary.

Another embodiment of the present invention is directed to a printer apparatus comprising a serial printhead, a horizontal scan drive, a vertical scan drive and a control means. The serial printhead is comprised of a column of N dot forming nozzles for projecting ink onto a printing area comprising columns on a recording substrate, wherein N is an integer greater than 2. The control means is operative to activate the horizontal scan drive to perform a scanning step and move the serial printhead horizontally across the printing area, wherein in each column of the printing area, the printhead deposits one or more dots from a subgroup comprised of S dot forming nozzles from the column of N dot forming nozzles, wherein S is an integer of from 1 to about N−1. During the scanning step, the control means is operative to activate not more than every Gth nozzle to deposit a dot in each column of the printing area, to activate a single nozzle to deposit a dot not more than every Gth column, wherein G is an integer from 1 to about S, and to vertically shift the subgroup of S dot forming nozzles among the N dot forming nozzles in at least two adjacent columns according to a predetermined pattern, with the provision that the predetermined pattern is not a periodic function. The control means is further operative to vertically advance the recording substrate by a height of about Q nozzles utilizing the vertical scan drive, wherein Q=(S/G), and then repeat the scanning step as necessary.

Still other objects, advantages and novel features of the present invention will become apparent to those skilled in the art from the following detailed description, which is simply by way of illustration various modes contemplated for carrying out the invention. As will be realized, the invention is capable of other different obvious aspects, all without departing from the invention. Accordingly, the drawings and description are illustrative in nature and not restrictive.

BRIEF DESCRIPTION OF THE DRAWING

While the specification concludes with claims particularly pointing out and distinctly claiming the present invention, it is believed the same will be better understood from the following description taken in conjunction with the accompanying drawings in which:

FIG. 3 is a table illustrating examples of bit maps which may be used in conjunction with the method of the present invention.

FIG. 4 depicts a pattern of printing utilizing the method of the present invention.

FIG. 5 depicts another pattern of printing utilizing the method of the present invention.

FIG. 6 depicts another pattern of printing utilizing the method of the present invention.

FIG. 7 depicts another pattern of printing utilizing the method of the present invention.

FIG. 8 depicts another pattern of printing utilizing the method of the present invention.

FIG. 9 depicts another pattern of printing utilizing the method of the present invention.

DETAILED DESCRIPTION

Reference will now be made in detail to various embodiments of the invention, an example of which is illustrated in the accompanying drawings, wherein the numerals indicate the same element throughout the views.

The invention will be described in a context of a monochrome ink jet cartridge but it will be evident from the following description that the principals of the invention are equally applicable to tri-color and multi-color ink jet cartridges.

Figure 1:
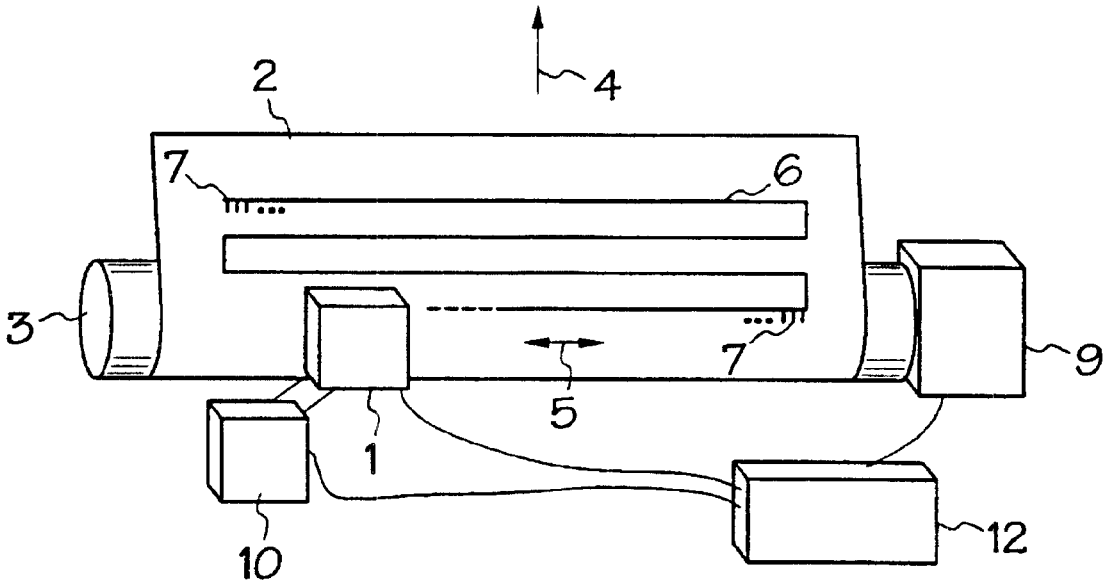
FIG. 1 is a schematic perspective view of a printhead relative to a recording substrate.

FIG. 1 shows a schematic perspective view of the basic arrangement of a printhead 1 relative to a recording substrate 2 to be imprinted. The recording substrate 2 is guided past the printhead 1 by a vertical scan drive 9 in a forward feed direction 4 in contact with a print roller 3. The printhead 1 can be reciprocated in a print line direction 5 perpendicular to the forward feed direction 4 by the horizontal scan drive 10. With each reciprocating motion, the printhead 1 passes over a plurality of print positions 7. To print on the recording substrate 2, the printhead 1 executes, in its entirety, a relative movement 6 to recording substrate 2. A control means 12 is operative to activate and control the horizontal scan drive 10, vertical scan drive 9, and the printhead 1.

Figure 2:
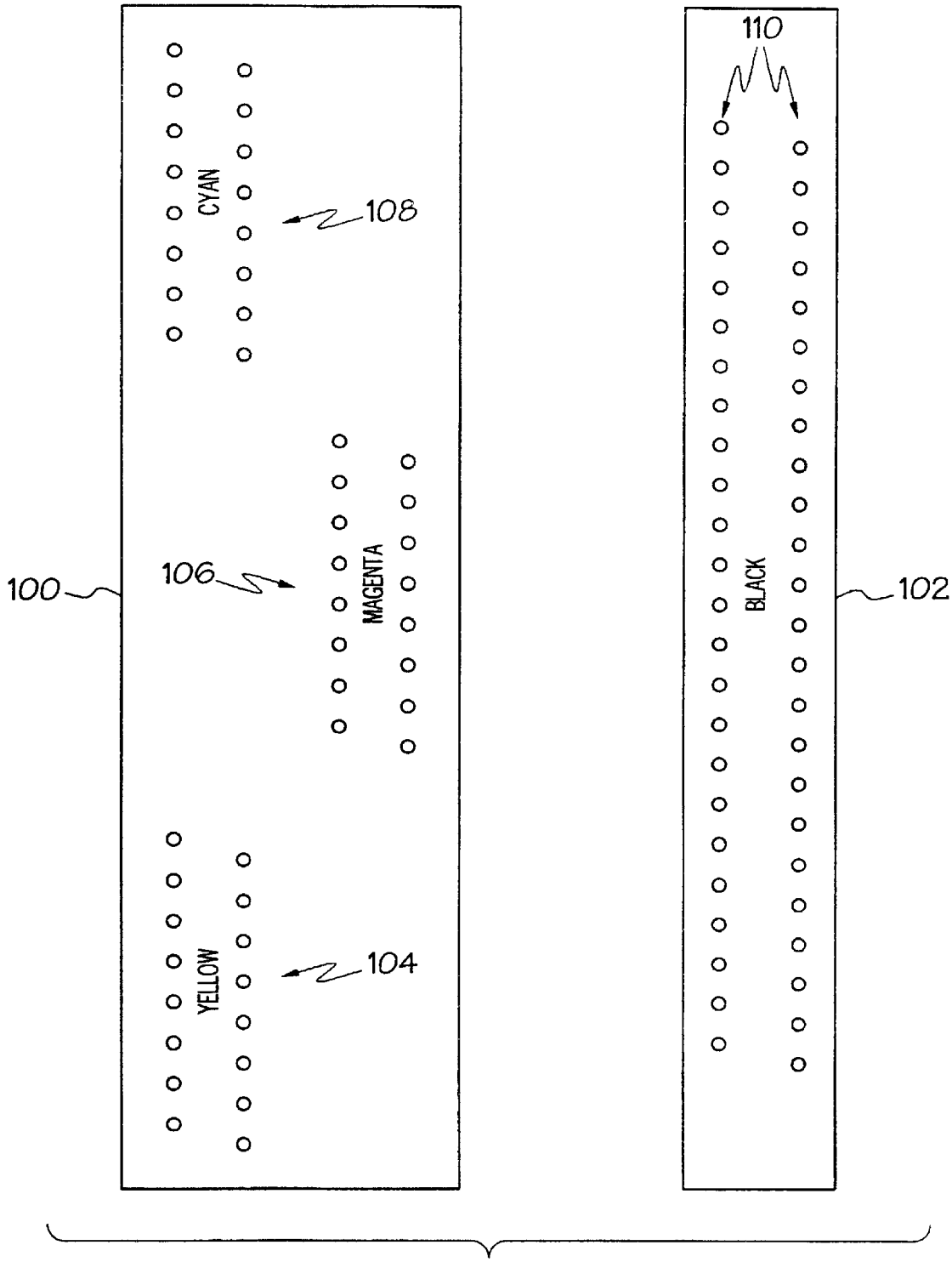
FIG. 2 (PRIOR ART)
FIG. 2 is a schematic view of a conventional tri-color printhead and black printhead which may be used with the method of the present invention.

In FIG. 2, there is shown an example of a conventional tri-color printhead 100 which may be used with the method of the present invention. Printhead 100 is typically mounted to part of a color cartridge (not shown), which in turn is carried by a moveable carriage assembly (not shown). Printhead 100 includes a plurality of dot forming nozzles 104, 106 and 108 for depositing three respective colors of ink on a print medium, preferably which is paper. Dot forming nozzles 104 define a first array of dot forming nozzles from which a first ink may be jetted onto the print medium. Dot forming nozzles 106 define a second array of dot forming nozzles from which a second ink may be jetted onto the print medium. Dot forming nozzles 108 define a third array of dot forming nozzles from which a third ink may be jetted onto the print medium. Printhead 100 is therefore capable of jetting three primary color inks onto the print medium using dot forming nozzles 104, 106 and 108.

In the particular embodiment shown in FIG. 2, dot forming nozzles 104, 106 and 108 each include an array of sixteen (16) dot forming nozzles, with each array of dot forming nozzles being disposed in two vertical rows of eight (8) dot forming nozzles. Further, dot forming nozzles 104, 106 and 108 are incorporated into a one-piece printhead. It should be appreciated, however, that printhead 100 may be constructed as a multiple-piece printhead, such as on a color cartridge having a three-piece printhead corresponding to each of the color dot forming nozzles 104, 106 and 108.

A monochrome printhead 102 which may also be used with the method of the present invention is shown in FIG. 2 in relation to the tri-color printhead 100. In the embodiment shown, the monochrome printhead 102 includes forty-eight (48) dot forming nozzles 110 defining an array of dot forming nozzles. Dot forming nozzles 110 are configured to jet a single color ink such as black ink, onto the print medium.

One skilled in the art will appreciate that the number of dot forming nozzles can vary depending on the application. Preferably, the number of nozzles will range from about 16 to about several hundred dot forming nozzles defining an array of dot forming nozzles. More preferably, the number of nozzles will range from about 16 to about 64 dot forming nozzles defining an array of dot forming nozzles. In addition, the array of dot forming nozzles may comprise one or more columns of dot forming nozzles.

The printing method of the present invention may comprise various levels of shingling. Shingling or interlaced printing comprises depositing adjacent inkjet dots on different scanning passes. For example, in a 50% shingling mode (i.e., 2 pass or 50% interlace level), approximately 50% of the dots are placed on any given pass of the printhead. The candidate dots are selected according to a checkerboard pattern. The remaining 50% of the dots are placed on a subsequent pass of the printhead.

FIG. 3 is a table illustrating various examples of shingling levels which may be used in conjunction with the present printing method. In the 100% shingling level (1 pass), all the ink dots to be printed must be placed in the raster during a single scan of the printhead. Accordingly, all of the positions in the raster must be available for printing during this single scan of the printhead. Using a bit mask with an 8 bit pattern as shown, all the positions in the raster are assigned a value of "1" indicating that all of the positions are available for printing.

For a 50% shingling level (2 pass), the ink dots are placed in the positions of a raster in two scans of the printhead across the print medium. During the first scan of the printhead, every other position in the raster is available for printing. Accordingly, every other bit in the bit mask is assigned a value of "1" as shown by the pattern "shingle $\mathbf{50}_1$" in FIG. 3. During a second scan of the printhead, a complimentary every other position in the raster is available for printing. Thus a complimentary every other bit in a bit mask is assigned a value of "1" as shown by the pattern "shingle $\mathbf{50}_2$". Thus, for a given scan of the printhead, if the bit mask corresponding to a particular position is assigned a value of "1" and the image data also indicates that an ink dot is to be placed in the position, then an ink dot will be placed in the position of the raster.

For a 25% shingling level (4 pass), only 25% of the positions in a raster are available for printing during a scan of the printhead across the print medium. Using a bit mask for a 25% shingling level with an 8 bit pattern as shown in FIG. 3, bits 1 and 5 for the first scan, bits 2 and 6 for the second scan, bits 3 and 7 for the third scan. and bits 4 and 8 for the fourth scan are assigned a value of "1", indicating that the corresponding positions in the raster are available for printing. Of course, using an 8 bit pattern as shown, this pattern repeats across the width of the raster. That is, the bit mask assigned the pattern name "shingle $\mathbf{25}_1$" used during a scan of the printhead repeats across the width of the raster.

In one embodiment of the present invention, the printing method comprises the steps of arranging a column of N dot forming nozzles for projecting ink onto a printing area comprising columns on a recording substrate, wherein N is an integer greater than 2. A scanning step is performed by moving the column of dot forming nozzles horizontally across the printing area and, in each column of the printing area, depositing one or more dots from a subgroup comprised of S dot forming nozzles from the column of N dot forming nozzles, wherein S is an integer of from 1 to about N−1. During the scanning step, in each column of the printing area, not more than every Gth nozzle deposits a dot and a single nozzle deposits a dot not more than every Gth column, wherein G is an integer from 2 to about S. The subgroup of S dot forming nozzles is shifted vertically among the N dot forming nozzles in at least two adjacent columns according to a predetermined pattern. The recording substrate is vertically advanced in a first direction by a height of about Q nozzles, wherein Q=(S/G). The scanning step is then repeated until the printing on the recording substrate is completed. In a more preferred embodiment, the step of vertically shifting the subgroup of S dot forming nozzles comprises shifting the subgroup of dot forming nozzles vertically in the first direction by step V among the N dot forming nozzles after deposition of one or more columns of dots during the scanning step until a sum of consecutive V's equal T, wherein T is an integer from 1 to about N−S. V is an integer from 1 to about N−S, and $T \geqq V$. When the sum of consecutive V's equal T, one or more columns of dots are deposited and the direction of vertical shifting is reversed. In a preferred embodiment, N ranges from about 16 to several hundred dot forming nozzles and S ranges from about 12 to less than N. In a more preferred embodiment, N ranges from about 16 to about 64, S ranges from about 12 to about 48, and G ranges from about 2 to about N/2. Preferably, S is an even numbered integer. In another preferred embodiment, S is evenly divisible by G. In a preferred embodiment, when S is not evenly divisible by G, Q is rounded up to the next integer.

In another embodiment of the present invention, the printing methods comprise the steps of arranging a column of N dot forming nozzles for projecting ink onto a printing area comprising columns on the recording substrate, wherein N is an integer greater than 2. A scanning step is performed comprising moving the column of dot forming nozzles horizontally across the printing area and in each column of the printing area depositing one or more dots from a subgroup comprised of S dot forming nozzles from the column of N dot forming nozzles, wherein S is an integer of from 1 to about N−1. During the scanning step in each column of the printing area, not more than every Gth nozzle deposits a dot and a single nozzle deposits a dot not more than every Gth column, wherein G is an integer from 1 to about S. The subgroup of S dot forming nozzles is shifted vertically among the N dot forming nozzles in at least two adjacent columns according to a predetermined pattern, with the provision that the predetermined pattern is not a periodic function. The recording substrate is vertically advanced in the first direction by a height of about Q nozzles, wherein Q=(S/G). The scanning step is repeated until the ink jet recording is completed. In a more preferred embodiment of the printing method, N ranges from about 16 to about 64, S ranges from about 12 to about 48, and G ranges from about 2 to about 5. Preferably, S is an even numbered integer. In another preferred embodiment, S is evenly divisible by G. In a preferred embodiment, when S is not evenly divisible by G, Q is rounded up to the next integer.

In another embodiment of the present invention the printer apparatuses comprise a serial printhead, a horizontal scan drive, a vertical scan drive and a control means. The serial printhead is comprised of a column of N dot forming nozzles for projecting ink onto a printing area comprising columns on a recording substrate, wherein N is an integer greater than 2. The control means is operative to activate the horizontal scan drive to perform a scanning step and move the serial printhead horizontally across the printing area, wherein in each column of the printing area, the printhead deposits one or more dots from a subgroup comprised of S dot forming nozzles from the column of N dot forming nozzles, wherein S is an integer of from 1 to about N−1. During the scanning step, the control means is further operative to activate not more than every Gth nozzle to deposit a dot in each column of the printing area, to activate a single nozzle to deposit a dot not more than every Gth column, wherein G is an integer from 2 to about S, and to vertically shift the subgroup of S dot forming nozzles among the N dot forming nozzles in at least two adjacent columns according to a predetermined pattern. The control means is further operative to activate the vertical scan drive to vertically advance the recording substrate by a height of about Q nozzles, wherein Q=(S/G), and then repeat the scanning step as necessary. In a preferred embodiment, N ranges from about 16 to several hundred dot forming nozzles and S ranges from 12 to less than N. In a more preferred embodiment, N is from about 16 to about 64, S is from about 12 to about 48 and G is from about 2 to about N/2. Preferably, S is an even numbered integer. In another preferred embodiment, S is evenly divisible by G. In a preferred embodiment, when S is not evenly divisible by G, Q is rounded up to the next integer.

In yet another embodiment of the present invention, the printer apparatuses comprise a serial printhead, a horizontal scan drive, a vertical scan drive and a control means. The serial printhead is comprised of a column of N dot forming nozzles for projecting ink onto a printing area comprising columns on a recording substrate, wherein N is an integer greater than 2. The control means is operative to activate the horizontal scan drive to perform a scanning step and move the serial printhead horizontally across the printing area, wherein in each column of the printing area, the printhead deposits one or more dots from a subgroup comprised of S dot forming nozzles from the column of N dot forming nozzles, wherein S is an integer of from 1 to about N−1. During the scanning step, the control means is operative to activate not more than every Gth nozzle to deposit a dot in each column of the printing area, to activate a single nozzle to deposit a dot not more than every Gth column, wherein G is an integer from 1 to about S, and to vertically shift the subgroup of S dot forming nozzles among the N dot forming nozzles in at least two adjacent columns according to a predetermined pattern, with the provision that the predetermined pattern is not a periodic function. The control means is further operative to vertically advance the recording substrate by a height of about Q nozzles utilizing the vertical scan drive, wherein Q=(S/G), and then repeat the scanning step as necessary. In a preferred embodiment, N ranges from about 16 to several hundred dot forming nozzles and S ranges from 12 to less than N. In a more preferred embodiment, N is from about 16 to about 64, S is from about 12 to about 48 and G is from about 2 to about N/2. Preferably, S is an even numbered integer. In another preferred embodiment, S is evenly divisible by G. In a preferred embodiment, when S is not evenly divisible by G, Q is rounded up to the next integer.

The following examples demonstrate various embodiments and advantages of the printing methods and printing apparatuses of the present invention.

EXAMPLE 1

In this example, an ink jet recording according to the present invention is prepared using a 16 nozzle print array (N=16), and a subgroup of 12 dot forming nozzles (S=12) is selected from the 16 nozzle print array. The printing method of this example utilizes a 50% shingling method (G=2). FIG. 4 depicts a bit mask of the present example. The numbers in FIG. 4 indicate on which pass the specific dot is deposited from one of the ink jet dot forming nozzles. For example, "1" represents a dot being deposited on the first pass and "2" represents a dot being deposited on the second pass, etc. The recording substrate is vertically advanced by a height of 6 dot forming nozzles (Q=6) after each scanning pass. This example depicts a transition of 1 step (V=1) for a total of 4 dot forming nozzles (T=4) before the vertical shifting switches to the opposite direction.

EXAMPLE 2

In this example, an inkjet recording according to the present invention is prepared using a 15 nozzle print array (N=15), and a subgroup of 12 dot forming nozzles (S=12) is selected from the 15 nozzle print array. The printing method of this example utilizes a 50% shingling method (G=2). FIG. 5 depicts a bit mask of the present example. The numbers in FIG. 5 indicate on which pass the specific dot is deposited from one of the ink jet dot forming nozzles. For example, "1" represents a dot being deposited on the first pass and "2" represents a dot being deposited on the second pass, etc. The recording substrate is vertically advanced by a height of 6 dot forming nozzles (Q=6) after each scanning pass. In this example, the subgroup of S dot forming nozzles is an odd number. When the paper advance length (Q) is calculated, Q is rounded up to the next integer to obtain the proper paper advance length.

EXAMPLE 3

In this example, an inkjet recording according to the present invention is prepared using a 16 nozzle print array (N=16), and a subgroup of 12 dot forming nozzles (S=12) is selected from the 16 nozzle print array. The printing method of this example utilizes a 100% shingling method (G=1). FIG. 6 depicts a bit mask of the present example. The numbers in FIG. 6 indicate on which pass the specific dot is deposited from one of the ink jet dot forming nozzles. For example, "1" represents a dot being deposited on the first pass and "2" represents a dot being deposited on the second pass, etc. The recording substrate is vertically advanced by a height of 12 dot forming nozzles (Q=12) after each scanning pass. This example depicts a transition of 1 step (V=1) for a total of 4 dot forming nozzles (T=4) before the vertical shifting switches to the opposite direction.

EXAMPLE 4

In this example, an inkjet recording according to the present invention is prepared using a 13 nozzle print array (N=13), and a subgroup of 12 dot forming nozzles (S=12) is selected from the 13 nozzle print array. The printing method of this example utilizes a 25% shingling method (G=4). FIG. 7 depicts a bit mask of the present example. The numbers in FIG. 7 indicate on which pass the specific dot is deposited from one of the ink jet dot forming nozzles. For example, "1" represents a dot being deposited on the first pass and "2" represents a dot being deposited on the second pass, etc. The recording substrate is vertically advanced by a height of 3 dot forming nozzles (Q=3) after each scanning pass. In this example, the entire transition is just one dot forming nozzle (T=1).

EXAMPLE 5

In this example, an inkjet recording according to the present invention is prepared using a 13 nozzle print array (N=13), and a subgroup of 12 dot forming nozzles (S=12) is selected from the 13 nozzle print array. The printing method of this example utilizes a 25% shingling method (G=4). FIG. 8 depicts a bit mask of the present example. The numbers in FIG. 8 indicate on which pass the specific dot is deposited from one of the ink jet dot forming nozzles. For example, "1" represents a dot being deposited on the first pass and "2" represents a dot being deposited on the second pass, etc. The recording substrate is vertically advanced by a height of 3 dot forming nozzles (Q=3) after each scanning pass. This example depicts a transition of 1 step (V=1) for a total of 3 dot forming nozzles (T=3).

EXAMPLE 6

In this example, an inkjet recording according to the present invention is prepared using a 16 nozzle print array (N=16), and a subgroup of 12 dot forming nozzles (S=12) is selected from the 16 nozzle print array. The printing method of this example utilizes a 50% shingling method (G=2). FIG. 9 depicts a bit mask of the present example. The numbers in FIG. 9 indicate on which pass the specific dot is deposited from one of the ink jet dot forming nozzles. For example, "1" represents a dot being deposited on the first pass and "2" represents a dot being deposited on the second pass, etc. The recording substrate is vertically advanced by a height of 6 dot forming nozzles (Q=6) after each scanning pass. This example depicts a transition of 2 steps (V=2) for a total of 4 dot forming nozzles (T=4).

The foregoing description of the various embodiments of the invention has been presented for the purposes of illustration and description. It is not intended to be exhaustive or to limit the invention to the precise form disclosed. Many alternatives, modifications, and variations will be apparent to those skilled in the art of the above teaching. Accordingly, this invention is intended to embrace all alternatives, modifications, and variations that have been discussed herein, and others that fall within the spirit and broad scope of the claims.

We claim:

1. A printing method comprising the steps of:

(a) arranging a column of N dot forming nozzles for projecting ink onto a printing area comprising columns on a recording substrate, wherein N is an integer greater than 2;

(b) performing a scanning step, the scanning step comprising moving the column of dot forming nozzles horizontally across the printing area and in each column of the printing area depositing one or more dots from a subgroup comprised of S dot forming nozzles from the column of N dot forming nozzles, wherein S is an integer of from 1 to about N−1;

wherein during the scanning step:

(i) in each column of the printing area not more than every Gth nozzle deposits a dot and a single nozzle deposits a dot not more than every Gth column, wherein G is an integer from 2 to about S; and (ii) the subgroup of S dot forming nozzles is shifted vertically among the N dot forming nozzles in at least two adjacent columns according to a predetermined pattern;

(c) advancing the recording substrate vertically in a first direction by a height of about Q nozzles, wherein Q=(S/G); and (d) repeating the scanning step.

2. The printing method of claim 1, wherein the step of vertically shifting the subgroup of S dot forming nozzles comprises shifting the subgroup of dot forming nozzles vertically in the first direction by step V among the N dot forming nozzles after deposition of one or more columns of dots during the scanning step until a sum of consecutive V's equal T, wherein T is an integer from 1 to about N−S, V is an integer from 1 to about N−S, and T≧V; and wherein when the sum of consecutive V's equal T, one or more columns of dots are deposited and the direction of vertical shifting is reversed.

3. The printing method of claim 1, wherein S is an even numbered integer.

4. The printing method of claim 1, wherein S is evenly divisible by G.

5. The printing method of claim 1, wherein when S is not evenly divisible by G, Q is rounded up to the next numbered integer.

6. The printing method of claim 1, wherein N=64 and S=48.

7. The printing method of claim 1, wherein N=16 and S=12.

8. The printing method of claim 1, wherein G=2.

9. The printing method of claim 1, wherein G=4.

10. The printing method of claim 8, wherein N=16 and S=12.

11. The printing method of claim 8, wherein N=64 and S=48.

12. A printing method comprising the steps of:

(a) arranging a column of N dot forming nozzles for projecting ink onto a printing area comprising columns on a recording substrate, wherein N is an integer greater than 2;

(b) performing a scanning step, the scanning step comprising moving the column of dot forming nozzles horizontally across the printing area and in each column of the printing area depositing one or more dots from a subgroup comprised of S dot forming nozzles from the column of N dot forming nozzles, wherein S is an integer of from 1 to about N−1;

wherein during the scanning step:

(i) in each column of the printing area not more than every Gth nozzle deposits a dot and a single nozzle deposits a dot not more than every Gth column, wherein G is an integer from 1 to about S; and (ii) the subgroup S of dot forming nozzles is shifted vertically among the N dot forming nozzles in at least two adjacent columns according to a predetermined pattern, with the provision that the predetermined pattern is not a periodic function;

(c) advancing the recording substrate vertically in a first direction by a height of about Q nozzles, wherein Q=(S/G); and (d) repeating the scanning step.

13. The printing method of claim 12, wherein S is an even numbered integer.

14. The printing method of claim 12, wherein S is evenly divisible by G.

15. The printing method of claim 12, wherein when S is not evenly divisible by G, Q is rounded up to the next numbered integer.

16. The printing method of claim 12, wherein N=64 and S=48.

17. The printing method of claim 12, wherein N=16 and S=12.

18. The printing method of claim 12, wherein G=2.

19. The printing method of claim 12, wherein G=4.

20. The printing method of claim 18, wherein N=64 and S=48.

21. The printing method of claim 18, wherein N=16 and S=12.

22. A printer apparatus comprising:

a serial printhead comprised of a column of N dot forming nozzles for projecting ink onto a printing area comprising columns on a recording substrate, wherein N is an integer greater than 2;

a horizontal scan drive;

a vertical scan drive; and a control means, wherein the control means is operative to:

(a) activate the horizontal scan drive to perform a scanning step and move the serial printhead horizontally across the printing area, wherein in each column of the printing area a subgroup comprised of S dot forming nozzles from the column of N dot forming nozzles deposits one or more dots, wherein S is an integer of from 1 to about N−1;

wherein during the scanning step the control means is operative to:

(i) activate not more than every Gth nozzle to deposit a dot in each column of the printing area and activate a single nozzle to deposit a dot not more than every Gth column, wherein G is an integer from 2 to about S; and (ii) vertically shift the subgroup of S dot forming nozzles among the N dot forming nozzles in at least two adjacent columns according to a predetermined pattern;

(b) activate the vertical scan drive to advance the recording substrate vertically by a height of about Q nozzles, wherein Q=(S/G); and (c) repeat the scanning step.

23. The printing apparatus of claim 22, wherein S is an even numbered integer.

24. The printing apparatus of claim 22, wherein S is evenly divisible by G.

25. The printing apparatus of claim 22, wherein when S is not evenly divisible by G, Q is rounded up to the next numbered integer.

26. The printer apparatus of claim 22, wherein N=64 and S=48.

27. The printer apparatus of claim 22, wherein N=16 and S=12.

28. The printer apparatus of claim 22, wherein G=2.

29. The printer apparatus of claim 22, wherein G=4.

30. The printer apparatus of claim 28, wherein N=64 and S=48.

31. The printer apparatus of claim 28, wherein N=16 and S=12.

32. A printer apparatus comprising:

a serial printhead comprised of a column of N dot forming nozzles for projecting ink onto a printing area comprising columns on a recording substrate, wherein N is an integer greater than 2;

a horizontal scan drive;

a vertical scan drive; and a control means, wherein the control means is operative to:

(a) activate the horizontal scan drive to perform a scanning step and move the serial printhead horizontally across the printing area, wherein in each column of the printing area a subgroup comprised of S dot forming nozzles from the column of N dot forming nozzles deposits one or more dots, wherein S is an integer of from 1 to about N−1;

wherein during the scanning step, the control means is further operative to:

(i) activate not more than every Gth nozzle to deposit a dot in each column of the printing area and activate a single nozzle to deposit a dot not more than every Gth column, wherein G is an integer from 1 to about S; and (ii) vertically shift the subgroup of S dot forming nozzles among the N dot forming nozzles in at least two adjacent columns according to a predetermined pattern, with the provision that the predetermined pattern is not a periodic function;

(b) activate the vertical scan drive to advance the recording substrate vertically by a height of about Q nozzles, wherein Q=(S/G); and (c) repeat the scanning step.

33. The printing apparatus of claim 32, wherein S is an even numbered integer.

34. The printing apparatus of claim 32, wherein S is evenly divisible by G.

35. The printing apparatus of claim 32, wherein when S is not evenly divisible by G, Q is rounded up to the next numbered integer.

36. The printer apparatus of claim 32, wherein N=64 and S=48.

37. The printer apparatus of claim 32, wherein N=16 and S=12.

38. The printer apparatus of claim 32, wherein G=2.

39. The printer apparatus of claim 32, wherein G=4.

40. The printer apparatus of claim 38, wherein N=64 and S=48.

41. The printer apparatus of claim 38, wherein N=16 and S=12.

* * * * *